US008875566B2

(12) United States Patent
Hoffmann et al.

(10) Patent No.: US 8,875,566 B2
(45) Date of Patent: Nov. 4, 2014

(54) METHOD FOR MONITORING THE STATE OF A PIEZOELECTRIC INJECTOR OF A FUEL INJECTION SYSTEM

(75) Inventors: Robert Hoffmann, Rouhstorf/Rott (DE); Michael Katzenberger, Regensburg (DE); Nicolas Nozeran, Tegernheim (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/001,339

(22) PCT Filed: Feb. 21, 2012

(86) PCT No.: PCT/EP2012/052942

§ 371 (c)(1),
(2), (4) Date: Aug. 23, 2013

(87) PCT Pub. No.: WO2012/113796

PCT Pub. Date: Aug. 30, 2012

(65) Prior Publication Data

US 2013/0333455 A1 Dec. 19, 2013

(30) Foreign Application Priority Data

Feb. 23, 2011 (DE) ..... 10 2011 004 613

(51) Int. Cl.
*F02D 41/02* (2006.01)
*F02D 41/22* (2006.01)
*F02D 41/20* (2006.01)

(52) U.S. Cl.
CPC ..... *F02D 41/02* (2013.01); *F02D 41/221* (2013.01); *F02D 41/2096* (2013.01); *F02D 2041/224* (2013.01)
USPC ..... 73/114.45; 73/114.49

(58) Field of Classification Search
USPC ..... 73/114.15, 114.45, 114.49
See application file for complete search history.

(56) References Cited

U.S. PATENT DOCUMENTS 6,784,596 B2 * 8/2004 Rueger et al. ..... 310/316.03
6,820,474 B2 * 11/2004 Mrosik et al. ..... 73/114.51

(Continued)

FOREIGN PATENT DOCUMENTS

DE 10215610 A1 10/2002 ..... F02D 41/24
DE 10360019 A1 7/2005 ..... F02D 35/02

(Continued)

OTHER PUBLICATIONS

International Search Report and Written Opinion, Application No. PCT/EP2012/052942, 13 pages, May 21, 2012.

*Primary Examiner* — Freddie Kirkland, III
(74) *Attorney, Agent, or Firm* — King & Spalding L.L.P.

(57) ABSTRACT

A method is disclosed for monitoring the state of a piezoelectric injector of the fuel injection system of an internal combustion engine, the piezoelectric injector having a piezoelectric actuator and a nozzle needle that can be moved by said piezoelectric actuator. The piezoelectric injector can be operated in a partial-stroke mode and a full-stroke mode. In the partial-stroke mode, the curve of an electrical parameter over time is recorded, the maximum value of the curve is determined, a constant parameter value that arises after the presence of the maximum value is determined, the duration between the presence of the maximum value and the reaching of the constant parameter value is determined, the difference between the maximum value and the constant parameter value is determined, and conclusions about the state of the piezoelectric injector are drawn on the basis of the determined duration and the determined difference.

10 Claims, 1 Drawing Sheet

(56) References Cited

U.S. PATENT DOCUMENTS

| | | | | |
|---|---|---|---|---|
| 6,849,988 | B2 * | 2/2005 | Rueger | 310/316.03 |
| 6,863,055 | B2 * | 3/2005 | Rueger | 123/478 |
| 6,904,354 | B2 | 6/2005 | Kuegel et al. | 701/104 |
| 7,617,813 | B2 | 11/2009 | Pirkl et al. | 123/490 |
| 7,628,146 | B2 | 12/2009 | Kloppenburg et al. | 123/673 |
| 7,802,561 | B2 | 9/2010 | Beilharz et al. | 123/498 |
| 8,239,115 | B2 | 8/2012 | Ascher et al. | 701/103 |
| 8,365,704 | B2 | 2/2013 | Beilharz et al. | 123/480 |
| 8,406,982 | B2 * | 3/2013 | Yamada et al. | 701/103 |
| 8,423,263 | B2 * | 4/2013 | Yamada et al. | 701/103 |
| 8,646,323 | B2 * | 2/2014 | Takashima | 73/114.49 |
| 2009/0319157 | A1 * | 12/2009 | Ishizuka | 701/106 |
| 2014/0007665 | A1 * | 1/2014 | Katzenberger et al. | 73/114.48 |
| 2014/0033811 | A1 * | 2/2014 | Hoffmann et al. | 73/114.49 |

FOREIGN PATENT DOCUMENTS

| | | | | |
|---|---|---|---|---|
| DE | 102004053266 | A1 | 5/2006 | F02D 41/20 |
| DE | 102004062073 | A1 | 7/2006 | F02D 41/20 |
| DE | 102004058971 | B4 | 12/2006 | F02D 41/20 |
| DE | 102010040253 | A1 | 3/2012 | F02M 51/06 |
| EP | 1884655 | A1 | 2/2008 | F01L 9/04 |
| EP | 2113647 | A2 | 11/2009 | F02D 41/20 |
| WO | 2009/010374 | A1 | 1/2009 | F02D 41/20 |
| WO | 2012/113796 | A1 | 8/2012 | F02D 41/20 |

* cited by examiner

METHOD FOR MONITORING THE STATE OF A PIEZOELECTRIC INJECTOR OF A FUEL INJECTION SYSTEM

CROSS-REFERENCE TO RELATED APPLICATIONS

This application is a U.S. National Stage Application of International Application No. PCT/EP2012/052942 filed Feb. 21, 2012, which designates the United States of America, and claims priority to DE Application No. 10 2011 004 613.5 filed Feb. 23, 2011, the contents of which are hereby incorporated by reference in their entirety.

TECHNICAL FIELD

The disclosure relates to a method for monitoring the state of a piezoelectric injector, as used in conjunction with fuel injection in motor vehicles.

BACKGROUND

A piezoelectric fuel injector comprises a piezoelectric actuator, which converts an electrical drive signal into a mechanical lifting movement. A nozzle needle is controlled by said lifting movement, with which the fuel flow through the injection holes of a nozzle unit can be more or less enabled in order to enable a desired quantity of fuel to be injected into a cylinder of the vehicle in a suitable manner depending on the electrical drive signal.

A piezoelectric actuator has the property that it outputs an electric signal in the event of a mechanical pressure load, so that it can also be used as a sensor for detection of the prevailing pressure in the piezoelectric injector. By means of said type of detection of the current pressure or a pressure change and the resulting force actions on the piezoelectric element, conclusions can be drawn regarding the lifting movement of the nozzle needle.

Furthermore, the operation of a piezoelectric injector having a piezoelectric actuator and a nozzle needle movable thereby at different times in a partial stroke movement and in a full stroke movement is already known. The piezoelectric actuator is thereby acted upon by a charge amount from a voltage, current and charge source, which has a voltage value dependent on the current injection profile demand and extends the piezoelectric actuator in order to move the nozzle needle in a respectively required manner. In partial stroke mode only part of the possible flow cross-section is opened, so that the flow is choked and only a relatively small quantity of fuel is injected into the respective cylinder, and the nozzle needle is not moved as far as its mechanical stop position. In full stroke mode the maximum possible flow cross-section is fully opened, so that the choke effect is completely removed and a relatively large amount of fuel is injected into the respective cylinder, and the nozzle needle is in its mechanical stop position.

A method and a device for shaping an electrical control signal for an injection pulse are known from WO 2009/010374 A1. Using the curve profile of the electrical control signal, the injection rate of the fuel injector is controlled depending on the rail pressure, on the stroke travel and/or on the opening duration of the fuel injector. The profile of the electrical control signal can be formed freely in relation to at least one pulse edge and/or amplitude for at least one partial quantity to be injected. Said shaping of the injection pulse is carried out in such a way that the specified amount of fuel to be injected is kept constant independently of the profile of the electrical control signal. By means of the injected partial quantity, the injected fuel quantity achieves an intermediate level, which is maintained for a specified holding time.

Other known injection systems for internal combustion engines, especially those with a piezoelectric drive, use methods for improvement of the injection behavior, whereby reference measurements are carried out in the factory during the manufacture or the final testing of the injectors and correction values obtained using said reference measurements are provided for the respective injector depending on the specimen. Such methods are e.g. known from DE 102 15 610 A1 and DE 10 2004 053 266 A1.

During installation of the injector in an internal combustion engine, said correction values are transmitted to the injection controller. From this, especially in relation to current emission legislation requirements, it is necessary to show a definite relationship between a respective injector and respective associated correction values. Furthermore, producing a matrix of correction values and the transfer of the values into the controller requires carrying out multiple working steps, which is associated with a non-negligible outlay of time.

The injection behavior of an internal combustion engine is in principle to be adjusted so that applicable legal regulations in relation to exhaust emissions and fuel consumption are satisfied. Compliance with said regulations is currently guaranteed using other sensors, including e.g. cylinder pressure sensors and/or knock sensors.

In DE 10 2010 040 253.2 a method for monitoring the state of a piezoelectric injector of a fuel injection system having a piezoelectric actuator and a nozzle needle movable thereby is described, with which the piezoelectric injector can be operated in a partial stroke mode and in a full stroke mode. This method involves the detection of electrical measurement values of the piezoelectric injector in partial stroke mode, a comparison of the recorded electrical measurement values with associated comparison values and the drawing of conclusions regarding the state of the piezoelectric injector from the comparison result.

SUMMARY

One embodiment provides a method for monitoring the state of a piezoelectric injector of the fuel injection system of an internal combustion system having a piezoelectric actuator and a nozzle needle movable by the same, with which the piezoelectric injector can be operated in a partial stroke mode and in a full stroke mode, wherein in the partial stroke mode the profile of an electrical parameter is recorded against time, the maximum value of the profile is determined, a constant parameter value is determined, which is established following the occurrence of the maximum value, the time duration between the occurrence of the maximum value and achieving the constant parameter value is determined, the difference between the maximum value and the constant parameter value is determined and using the determined time duration and the determined difference, conclusions are drawn regarding the state of the piezoelectric injector.

In a further embodiment, the method comprises using the determined time duration and the determined difference, conclusions are drawn as to whether fuel was introduced into the combustion chamber of the internal combustion engine.

In a further embodiment, the method comprises using the determined time duration and the determined difference, conclusions are drawn as to whether the rate of penetration of the fuel into the combustion chamber lies in a desired range or outside the desired range.

In a further embodiment, other parameters of the internal combustion engine are used for assessment of the state of the piezoelectric injector.

In a further embodiment, the method comprises the other parameters include information about the current torque demand and/or the current load.

In a further embodiment, the other parameters include information about the rail pressure, the exhaust gas temperature, the revolution rate of the internal combustion engine, the temperature of the cooling water and the fuel quality.

In a further embodiment, by using said parameters, conclusions are drawn regarding the causes of the piezoelectric travel occurring exceeding the idle stroke.

In a further embodiment, the rail pressure is determined as a cause of the piezoelectric travel exceeding the idle stroke.

In a further embodiment, the thermal expansion of the nozzle needle is determined as a cause of the piezoelectric travel exceeding the idle stroke.

In a further embodiment, the method comprises the electrical parameter is the electrical voltage, the energy or the capacitance applied to the piezoelectric injector.

BRIEF DESCRIPTION OF THE DRAWINGS

Example embodiments of the invention are discussed below with reference to the figures, in which.

DETAILED DESCRIPTION

Embodiments of the invention provide an improved method for monitoring the state of a piezoelectric injector of a fuel injection system.

One embodiment provides a method for monitoring the state of a piezoelectric injector of a fuel injection system of an internal combustion system having a piezoelectric actuator and a nozzle needle movable thereby, with which the piezoelectric injector can be operated in a partial stroke mode and in a full stroke mode, wherein in the partial stroke mode the profile of an electrical parameter is detected against time, the maximum value of the profile is determined, a constant parameter value is determined, which is established following the occurrence of the maximum value, the time period between the occurrence of the maximum value and achieving the constant parameter value is determined, the difference between the maximum value and the constant parameter value is determined and conclusions are drawn regarding the state of the piezoelectric injector using the determined time duration and the determined difference.

In some embodiments of the disclosed method for monitoring the state of a piezoelectric injector, new information can be derived that adequately describes the state of the injection system in order to satisfy legal requirements.

Embodiments of the method can, for example, be used in conjunction with self-igniting internal combustion engines that are provided with a piezoelectric common-rail injection system. The method according to the invention is particularly advantageously suitable for continuous monitoring during a partial stroke injection in all cases of the application of said partial stroke injection. The method is designed in terms of a passive observer and is not tied to particular working or ambient conditions. Consequently, it is not necessary to wait until suitable operating conditions exist and it is also not necessary to request a particular manner of operation of the internal combustion engine in order to be able to carry out the claimed method.

Some embodiments relate to monitoring the state or the correct functioning of a piezoelectrically driven fuel injector, especially an injector with which the nozzle needle is directly driven by the piezoelectric element and the needle lift is positionally regulated.

Figure 1:
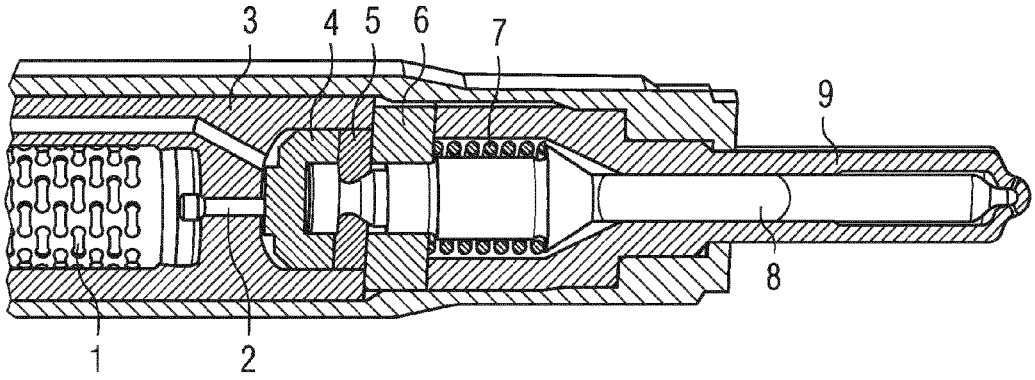
FIG. 1 shows an example piezoelectric injector, with which a method according to the invention can be used.

FIG. 1 shows a sketch for explaining the design of a piezoelectric injector, with which a method according to the invention can be used. The illustrated piezoelectric injector comprises a piezoelectric actuator 1 provided with a tubular spring, a pin 2, a lever housing 3, a bell 4, a lever 5, an intermediate disk 6, a nozzle needle spring 7, a nozzle needle 8 and a nozzle body 9.

The piezoelectric actuator 1 consists of a plurality of individual thin layers, which expand with the application of an electrical voltage, i.e. they convert an applied electrical voltage into mechanical work or energy. Conversely, mechanical influences of the piezoelectric actuator cause electrical signals that can be measured. The achievable expansion of a piezoelectric actuator is dependent on parameters including its nominal length, the number of its layers, the nature of the polarization carried out and the ratio of its active area to its total area. If a piezoelectric actuator is charged, then it remains at its achieved expansion for the duration of the respective injection.

The example embodiment shown in FIG. 1 is a piezoelectric injector, in which the nozzle needle 8 is directly driven by the piezoelectric actuator 1. For this purpose, the piezoelectric actuator 1 is directly connected to the nozzle needle 8 via the pin 2, the bell 4 and the lever 5, which are stiff, positively guided coupling elements. Said direct connection of the nozzle needle to the piezoelectric actuator enables a reactive force input from the needle movement to the piezoelectric actuator, which can be detected in the capacitance profile. Each force input into the piezoelectric actuator results in a change of the measured capacitance.

The nozzle body 9 expands depending on temperature. The purpose of the nozzle needle spring 7 is to hold the nozzle needle 8 in its seat. Said expansion of the nozzle body 9 in the direction of its longitudinal axis, the so-called nozzle elongation, influences the maximum needle lift. Also the rail pressure occurring in the not shown rail causes lengthening of the nozzle body and compression of the nozzle needle.

During a needle opening process, charging of the piezoelectric actuator 1 initially takes place by applying current to the same. After overcoming the idle stroke, the expansion of the piezoelectric actuator 1 is transferred by means of the pin 2 to the bell 4, wherein the pin 2 is guided into the lever housing 3. The bell 4 presses on both sides symmetrically on the lever 5, which forms a pair of levers. Said levers roll on the intermediate disk 6 in the manner of a rocker. The respective application point of each of the two levers lies in a notch of the nozzle needle 8.

By means of the mechanism described above, the axial pushing force of the piezoelectric actuator 1 is transferred to the nozzle needle 8. The nozzle needle is raised from its seat once the lever force exceeds the sum of the spring force and the hydraulic force and the elasticity of the nozzle body 9 no longer causes the needle seat to follow the nozzle needle.

After a defined travel of e.g. 100 μm, which is travelled for a pressure of 200 MPa, the needle stop is incident upon the intermediate disk. It builds up a contact force, which reacts upon the piezoelectric actuator 1.

With such piezoelectric actuators 1 it is possible to raise the nozzle needle 8 only partly from its seat and to hold it at the so-called partial lift. The opened flow cross-section between the nozzle needle and the nozzle body is thereby smaller than the sum of the cross-sections of all nozzle holes.

As has been explained above, with the piezoelectric injector shown in FIG. 1 the piezoelectric actuator 1 acts via stiff coupling elements 2, 4, 5 directly on the nozzle needle 8 and vice-versa. This enables detection of the force actions on the nozzle needle 8 by means of a measurement of the electrical voltage on the piezoelectric actuator 1. A piezoelectric actuator has the property of remaining at an expansion achieved by electrical charging at least while it is necessary for the current injection process.

Moreover, it has been explained above that with a directly driven piezoelectric injector it is possible to operate the same in a partial stroke mode, in which the nozzle needle is only raised from the needle seat by a part of the maximum possible travel and remains there.

Figure 2:
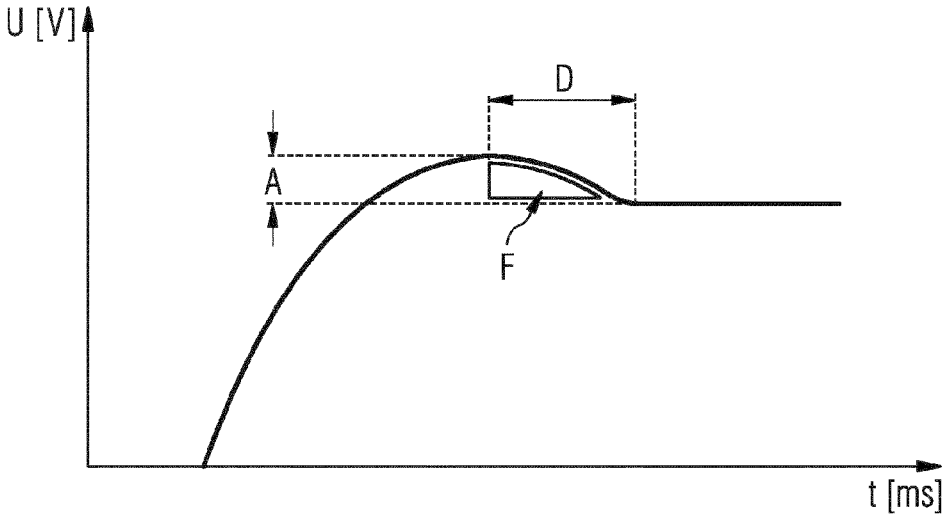
FIG. 2 shows an example profile of electrical voltage applied to a piezoelectric actuator against time.

FIG. 2 shows a diagram for illustration of the profile of the voltage U applied to the piezoelectric actuator depending on the time t in such a partial stroke mode. The time t is thereby plotted along the abscissa and the voltage U is plotted along the ordinate.

It is apparent from FIG. 2 that the voltage U applied to the piezoelectric actuator has a significant profile dependent on the opened flow cross-section, which is proportional to the needle stroke, and on the fuel pressure. This is characterized in that a maximum is formed at the start of the partial stroke injection and following said maximum a decrease takes place to a continuing constant voltage level. Alternatively to said measured injector voltage, the calculated energy or the calculated capacitance can also be used as parameters.

It can also be seen from FIG. 2 that from the profile shown therein of the electrical voltage against time, the maximum value of said profile, the constant voltage value established after the occurrence of said maximum value, the time duration D between the occurrence of the maximum value and achieving the established constant voltage value and the difference A between the maximum value and the voltage value established thereafter can be determined. Said time duration D and said difference A thereby describe an area F that is indicated in FIG. 2. Said area F, which is described by the time duration D and the voltage difference A, is a measure of the injection rate achieved by means of the needle lift.

The absolute voltage level of the constant profile correlates with the total travel of the piezoelectric actuator until the achieved injection, i.e. with the sum of the idle stroke and the nozzle elongation that has taken place.

With the invention during the entire duration of a partial stroke injection a repeated detection of the respective measurement parameter takes place, for the example embodiment shown it is a repeated detection of the voltage applied to the piezoelectric actuator. For this purpose a fast analog to digital converter is used, with which e.g. a series of 40 voltage values is determined at a time interval of 5 μs.

The above-mentioned characteristic parameters for the area F, i.e. the time duration D between the occurrence of the maximum value and achieving the subsequently established constant voltage value and the difference A between the maximum value and the subsequently established voltage value, are stored in a memory and statistically analyzed. Expected values are formed from test measurements and previous measurements on the piezoelectric injector under test and control value and gradient comparisons are carried out to draw conclusions regarding the state of the respective piezoelectric injector.

Moreover, preferably during the assessment of the state of the piezoelectric injector, data regarding the current engine state are taken into account. These data include the current torque demand, the revolution rate of the engine, the temperature of the cooling water and the profile of the exhaust gas temperature. Moreover, preferably the values of the tank level indicator from the current and the preceding driving cycles are compared with each other. It is also to be noted that in the case of refueling of the vehicle with fuel of significantly different fuel quality a step change can occur in the achieved measurement signal profile. Such a step change has to be filtered out in the analysis of the measurement results in order to avoid undesirably causing an entry in the error register.

From said characteristic parameters for the area F, i.e. the duration D between the occurrence of the maximum value and achieving the subsequently established constant voltage value, and the difference A between the maximum value and the subsequently established constant voltage value, at least indications can be given as to whether any fuel was injected into the combustion chamber of the internal combustion engine and whether the rate of penetration was in the intended range or was significantly too low or significantly too high.

Said indication is sufficient for functional monitoring in the sense of currently applicable regulations.

If—as has been described above—the parameters describing the current engine mode, especially the current torque demand and the current load, are also taken into account and other measurement variables such as the rail pressure and the exhaust gas temperature are also included in the assessment of the state of the piezoelectric injector, then an indication can advantageously be given of the cause of the piezoelectric travel exceeding the idle stroke, e.g. the indication that the cause lies in the occurring rail pressure or that the cause can be traced to a thermal expansion of the nozzle body.

What is claimed is:

1. A method for monitoring the state of a piezoelectric injector of the fuel injection system of an internal combustion system having a piezoelectric actuator configured to move a nozzle needle, the piezoelectric injector being configured for operation in a partial stroke mode and a full stroke mode, the method comprising:

in the partial stroke mode, recording the profile of an electrical parameter versus time, determining an occurrence of a maximum value of the profile, identifying a constant parameter value that occurs following the occurrence of the maximum value, determining a time duration between the occurrence of the maximum value and the constant parameter value, determining a difference between the maximum value and the constant parameter value, and drawing conclusions regarding a state of the piezoelectric injector based on the determined time duration and the determined difference between the maximum value and the constant parameter value.

2. The method of claim 1, comprising drawing conclusions as to whether fuel was introduced into the combustion chamber of the internal combustion engine based on the determined time duration and the determined difference between the maximum value and the constant parameter value.

3. The method of claim 1, comprising drawing conclusions as to whether the rate of penetration of the fuel into the combustion chamber lies in a desired range or outside the desired range based on the determined time duration and the determined difference between the maximum value and the constant parameter value.

4. The method of claim 1, wherein other parameters of the internal combustion engine are used for assessment of the state of the piezoelectric injector.

5. The method of claim 4, wherein the other parameters include information about at least one of a current torque demand and a current load.

6. The method of claim 4, wherein the other parameters include information about at least one of a rail pressure, an exhaust gas temperature, a revolution rate of the internal combustion engine, a temperature of cooling water, and a fuel quality.

7. The method of claim 6, comprising drawings conclusions regarding the causes of the piezoelectric travel occurring exceeding the idle stroke using said parameters.

8. The method of claim 7, wherein the rail pressure is determined as a cause of the piezoelectric travel exceeding the idle stroke.

9. The method of claim 7, wherein the thermal expansion of the nozzle needle is determined as a cause of the piezoelectric travel exceeding the idle stroke.

10. The method of claim 1, wherein the electrical parameter is the electrical voltage, the energy or the capacitance applied to the piezoelectric injector.

* * * * *

UNITED STATES PATENT AND TRADEMARK OFFICE

CERTIFICATE OF CORRECTION

PATENT NO. : 8,875,566 B2
APPLICATION NO. : 14/001339
DATED : November 4, 2014
INVENTOR(S) : Robert Hoffmann et al.

It is certified that error appears in the above-identified patent and that said Letters Patent is hereby corrected as shown below:

Title Page

Item (75), Inventors, 1st inventor, "Robert Hoffmann, Rouhstorf/Rott (DE)," should read "Robert Hoffmann, Ruhstorf/Rott (DE)"

Signed and Sealed this
Tenth Day of March, 2015

Michelle K. Lee

Michelle K. Lee
*Deputy Director of the United States Patent and Trademark Office*